US007191809B2

(12) United States Patent
Abe

(10) Patent No.: US 7,191,809 B2
(45) Date of Patent: Mar. 20, 2007

(54) CONNECTOR FOR DISPENSING LIQUID FROM A TANK

(75) Inventor: Koichi Abe, Gyoda (JP)

(73) Assignee: Surpass Industry Co. Ltd., Saitama (JP)

( * ) Notice: Subject to any disclaimer, the term of this patent is extended or adjusted under 35 U.S.C. 154(b) by 237 days.

(21) Appl. No.: 10/976,836

(22) Filed: Nov. 1, 2004

(65) Prior Publication Data

US 2005/0092392 A1 May 5, 2005

(30) Foreign Application Priority Data

Oct. 31, 2003 (JP) ..... 2003-373233

(51) Int. Cl.
*B65B 1/04* (2006.01)

(52) U.S. Cl. ..... 141/326; 141/291; 141/309; 220/303; 137/322

(58) Field of Classification Search ..... 141/285, 141/291, 302, 309, 325, 326; 220/288, 303; 137/320, 322
See application file for complete search history.

(56) References Cited

U.S. PATENT DOCUMENTS 2,356,327 A * 8/1944 Lebus ..... 220/203.26
5,526,956 A * 6/1996 Osgar ..... 222/83
6,505,863 B2 * 1/2003 Imai ..... 285/316

* cited by examiner

*Primary Examiner*—Timothy L. Maust
(74) *Attorney, Agent, or Firm*—Browdy and Neimark, PLLC

(57) ABSTRACT

During non-use of tank (53), a connector for dispensing liquid from the tank has no portion projecting from the tank, keeps the tank in its sealed condition, and makes no disturbance. Provided in drum cap (51) threadably engaged with a neck of the tank are liquid outlet plug installation hole (55) and dual-purpose gas/liquid inlet plug installation hole (56). Siphon tube (59) extending downward to the bottom of the tank is provided inside hole. (55) of liquid plug (57) an upper surface of which does not extend beyond an upper surface of the drumcap. Dual-purpose gas/liquidplug (70) is provided inside the hole (56) not having its upper surface extend beyond the upper surface of the drum cap. Caps (62 and 75) are detachably fitted in the liquid plug and the gas/liquid plug, respectively, to seal upper openings of these plugs (57 and 70), respectively.

20 Claims, 7 Drawing Sheets

CONNECTOR FOR DISPENSING LIQUID FROM A TANK

BACKGROUND OF THE INVENTION

1. Field of the Invention

The present invention relates to a connector for dispensing liquid from a tank, and more particularly to such a connector of a tank made of a synthetic resin, wherein: the tank contains liquid such as a highly purified chemical in liquid form or the like therein; and, the connector is mounted on an upper surface of the tank.

2. Description of the Related Art

Heretofore, a conventional liquid dispensing mechanism 1, for example such as one shown in FIG. 10 for dispensing liquid from a tank 2 made of a synthetic resin has been used in the art. Such a conventional liquid dispensing mechanism 1 is constructed of: an inner lid 4; and, an annular cap 5 provided with a female screw portion through which both the inner lid 4 and the annular cap 5 are fixedly mounted on a mouth portion 3 of the tank 2. Formed in an upper surface of the inner lid 4 are: an externally threaded connecting mouth portion 6 which is connected with a pressurized gas supply means (shown in phantom lines in FIG. 10) for supplying a pressurized gas from the gas supply means to the tank 2 through the connecting mouth portion 6 in order to forcibly dispense the liquid contained in the tank 2 from this tank 2 to the outside; and, another externally threaded connecting mouth portion 7 which is connected with a liquid dispensing means (shown in phantom lines in FIG. 10) for dispensing the liquid contained in the tank 2 to the outside though the connecting mouth portion 7, wherein both the connecting mouth portions 6 and 7 extend upward from the upper surface of the inner lid 4, as viewed in FIG. 10. Further, fixedly mounted in the externally threaded connecting mouth portion 7 of the inner lid 4 is a siphon tube 8 which extends up to an inner bottom surface of the tank 2.

In this conventional liquid dispensing mechanism 1, since each of the externally threaded mouth portions 6, 7 extends upward from the upper surface of the inner lid 4, the loot of each of these mouth portions 6, 7 is most susceptible to failure when subjected to a heavy load applied to the mouth portions 6, 7 in a direction perpendicular to the longitudinal axis of each of the mouth portions 6, 7. When the roots of these mouth portions 6, 7 of the inner lid 4 are broken under such heavy load, leakage of the liquid (i.e., chemical) and the pressurized gas both contained in the tank 2 occurs. This is a problem inherent in the prior art.

In order to solve the above problem, the applicant of the subject Patent application has already proposed a liquid dispensing mechanism (shown in FIG. 11) in his previous Japanese Patent application Laid-Open No. 2000-146089, in which mechanism: an inner lid 11 is fixedly mounted on a neck portion of a liquid tank through a tightening cap; and, formed in the inner lid 11 are a pair of concave portions which are threaded to form a pair of female screw holes 12, 13. In this previous mechanism, as shown in FIG. 11, one 12 of the female screw holes 12, 13 of the inner lid 11 threadably receives therein a pressurized gas supply plug 14 in which a valve 18 is incorporated. This incorporated valve 18 is forcibly pushed upward to seat on its corresponding valve seat and therefore to close a pressurized gas supply opening 20 in a normal condition under the influence of a resilient force exerted by a compression coil spring 17. On the other hand, the other 13 of the female screw holes 12, 13 of the inner lid 11 threadably receives therein a liquid dispensing plug 14 in which a valve 30 is incorporated. This incorporated valve 30 is forcibly pushed upward to seat on its corresponding valve seat and therefore to close a liquid dispensing opening 32 in a normal condition under the influence of a resilient force exerted by a compression coil spring 28.

In the previous mechanism disclosed in the Japanese Patent application Laid-Open No. 2000-146089: since the plugs 14 and 15 are embedded in the female screw holes 12 and 13, respectively, and therefore protected from any lateral load without fail, there is no fear of leakage of the liquid and the pressurized gas from the tank even when the plugs 14, 15 are subjected to a lateral heavy load when the liquid contained in the tank is dispensed from the tank to the outside.

However, this previous one of the liquid dispensing mechanisms suffers from another problem as follows: since both the pressurized gas supply plug 14 and the liquid dispensing plug 15 of the liquid dispensing mechanism extend upward beyond the inner lid 11, each of these plugs 14, 15 constitutes a serious encumbrance to the liquid dispensing mechanism.

SUMMARY OF THE INVENTION

Under such circumstances, the present invention was made to solve the problems inherent in the prior art. Consequently, it is an object of the present invention to provide a connector for dispensing liquid from a tank, wherein: the connector has no projecting portion during non-use of the tank, and is therefore free from any encumbrance during non-use of the tank; and, the connector is capable of keeping the tank in its sealed condition during non-use of the tank.

In accordance with a first aspect of the present invention, the above object of the present invention is accomplished by providing:

A connector for dispensing liquid from a tank (53), the connector having a construction in which: both a liquid dispensing plug installation hole (55) and a dual-purpose gas/liquid supply plug installation hole (56) are formed in a drum cap (51) which is threadably engaged with a neck portion of the tank (53); a liquid plug (57), which is provided with a siphon tube (59) extending to an inner bottom surface of the tank (53), is fixedly mounted in the liquid dispensing plug installation hole.(55) in a manner such that the liquid plug (57) prevents its upper surface from being positioned in a level beyond an upper surface of the drum cap (51); a dual-purpose gas/liquid plug (70) is fixedly mounted in the dual-purpose gas/liquid supply plug installation hole (56) in a manner such that the dual-purpose gas/liquid plug (70) prevents its upper surface from being positioned in a level beyond the upper surface of the drum cap (51); and, a liquid cap (62) and a dual-purpose gas/liquid cap (75) are detachably mounted on the liquid plug (57) and the dual-purpose gas/liquid plug (70), respectively, in an insertion manner so as to hermetically close an upper opening portion of each of the plugs (57, 70).

In accordance with a second aspect of the present invention, the above object of the present invention is accomplished by providing:

The connector for dispensing the liquid from the tank (53) according to the first aspect of the present invention, wherein: the liquid cap (62) is threadably engaged with a male screw portion (57*a*) formed in an outer peripheral surface of the liquid plug (57); the dual-purpose gas/liquid cap (75) is threadably engaged with a male screw portion formed in an outer peripheral surface of the dual-purpose gas/liquid plug (70); the male screw portion (57*a*) of the liquid plug (57) differs in diameter from the male screw portion of the dual-purpose gas/liquid plug (70).

In accordance with a third aspect of the present invention, the above object of the present invention is accomplished by providing:

The connector for dispensing the liquid from the tank (53) according to the first aspect or the second aspect of the present invention, wherein: a pressure relief mechanism for relieving a pressure developed inside the tank (53) from the tank (53) is provided between: the liquid plug (57) and the liquid cap (62); and, between the dual-purpose gas/liquid plug (70) and the dual-purpose gas/liquid cap (75).

In accordance with a fourth aspect of the present invention, the above object of the present invention is accomplished by providing:

The connector for dispensing the liquid from the tank (53) according to the third aspect of the present invention, wherein the pressure relief mechanism is constructed of: a pressure relief passage (60, 74) formed in the plug (57, 70); and, a side hole (64, 76) formed in the cap (62, 75), wherein an upper opening portion of the pressure relief passage (60, 74) is closed by a side wall of the cap (62, 75) when the cap (62, 75) is threadably tightened, which upper opening portion of the pressure relief passage (60, 74) is permitted to communicate with the side hole (64, 76) when the cap (62, 75) is threadably loosened to separate the upper opening portion of the pressure relief passage (60, 74) from the side wall of the cap (62, 75).

In accordance with a fifth aspect of the present invention, the above object of the present invention is accomplished by providing:

The connector for dispensing the liquid from the tank (53) according to anyone of the first, second, third and the third aspects of the present invention, wherein an identification ring (65) for identifying said plug (57, 70) is mounted on an upper end portion of at least one of said plug installation holes (55, 56) in an insertion manner.

In accordance with a sixth aspect of the present invention, the above object of the present invention is accomplished by providing:

The connector for dispensing the liquid from the tank (53) according to the fifth aspect of the present invention, wherein the identification ring (65) is provided with a projecting portion or a concave portion in its inner peripheral surface, wherein the projecting portion or the concave portion indicates the type of liquid contained in the tank (53).

In accordance with a seventh aspect of the present invention, the above object of the present invention is accomplished by providing:

The connector for dispensing the liquid from the tank (53) according to any one of the first, second, third, fourth, fifth and the sixth aspects of the present invention, wherein said drum cap (51) is provided with a multi-purpose plug installation hole (81) in addition to the pair of said plug installation plugs (57, 70).

In accordance with an eighth aspect of the present invention, the above object of the present invention is accomplished by providing:

The connector for dispensing the liquid from the tank (53) according to the seventh aspect of the present invention, wherein: the liquid dispensing plug installation hole (57), the dual-purpose gas/liquid supply plug installation hole (70) and the multi-purpose plug installation hole (81) forms a triangular shape in their arrangement as a whole.

In accordance with a ninth aspect of the present invention, the above object of the present invention is accomplished by providing:

The connector for dispensing the liquid from the tank (53) according to the seventh or the eighth aspect of the present invention, wherein the multi-purpose plug installation hole (81) is capable of being used as a pressure relief port or the like.

In accordance with a tenth aspect of the present invention, the above object of the present invention is accomplished by providing:

The connector for dispensing the liquid from the tank (53) according to the seventh or the eighth aspect of the present invention, wherein the multi-purpose plug installation hole (81) is capable of being used as a secondary liquid plug installation hole or as a secondary dual-purpose gas/liquid plug installation hole.

In accordance with an eleventh aspect of the present invention, the above object of the present invention is accomplished by providing:

The connector for dispensing the liquid from the tank (53) according to any one of from the first aspect to the tenth aspect of the present invention, wherein: an annular wedge-shaped portion (57*c*) is formed adjacent to a male screw portion (57*b*) of each of the liquid plug (57) and the dual-purpose gas/liquid plug (70) to extend downward from the male screw portion (57*b*) which is also formed in a lower portion of each of the liquid plug (57) and the dual-purpose gas/liquid plug (70); the male screw portion of each of the liquid plug (57) and the dual-purpose gas/liquid plug (70) is threadably engaged with each of the plug installation holes (55, 56); and, an annular seat portion, with which the annular wedge-shaped portion (57*c*) is engaged, is formed in a lower portion of each of the plug installation holes (55, 56).

In accordance with a twelfth aspect of the present invention, the above object of the present invention is accomplished by providing:

The connector for dispensing the liquid from the tank (53) according to any one of from the first aspect to the eleventh aspect of the present invention, wherein an outer bottom surface of each of the liquid plug. (57) and the dual-purpose gas/liquid plug (70) abuts on an inner bottom surface of each of the plug installation holes (55, 56) and is welded to the inner bottom surface of each of the plug installation holes (55, 56).

In accordance with a thirteenth aspect of the present invention, the above object of the present invention is accomplished by providing:

The connector for dispensing the liquid from the tank (53) according to any one of from the first aspect to the twelfth aspect of the present invention, wherein the liquid plug (57) is equal in inner diameter to the dual-purpose gas/liquid plug (70).

In effect of the present invention: in the connector according to any one of the second, the fifth and the sixth aspect of the present invention, there is not any fear of misconnection of the connector at all; and, the connector according to any one of the third and the fourth aspect of the present invention, it is possible to relief the pressure developed inside the tank.

Further, in effect of the present invention: in the connector according to any one of the seventh and the tenth aspect of the present invention, it is possible to use the connector of the present invention as a multi-purpose connector in various applications; and, in the connector according to any one of the eleventh and the twelfth aspect of the present invention, both the liquid plug and the dual-purpose gas/liquid plug are prevented from rotating in their corresponding plug installation holes and capable of serving as sealing means inside these plug installation holes,

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Figure 1:
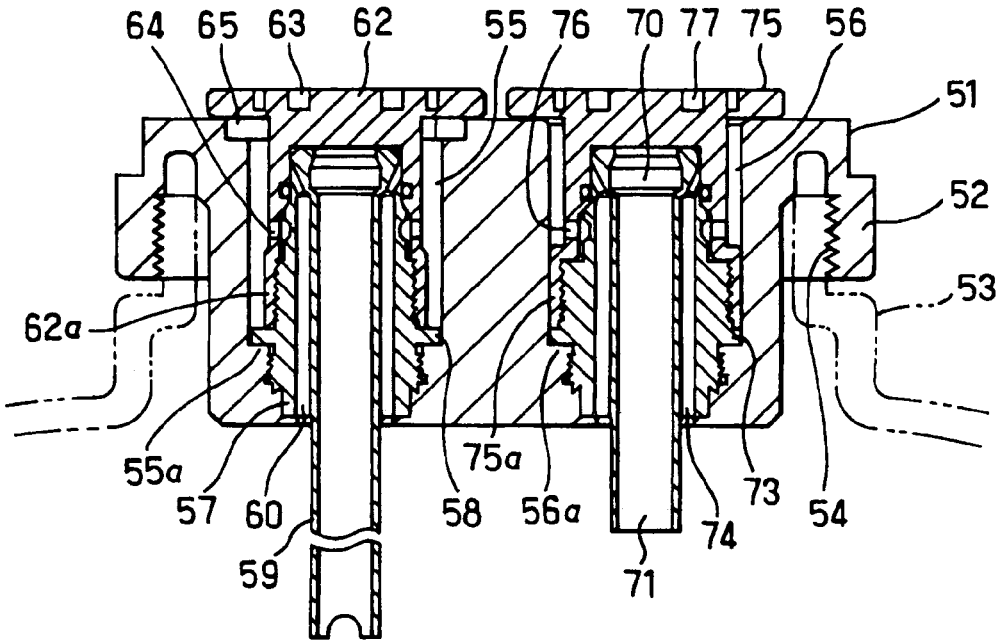
FIG. 1 is a longitudinal sectional view of an embodiment of a connector of the present invention, illustrating the connector in construction.

The best modes for carrying out the present invention will be described in detail using embodiments of the present invention with reference to the accompanying drawings, wherein: a reference numeral 51 denotes a drum cap; 52 denotes a sleeve portion; 53 denotes a tank; 54 denotes a female screw portion; 55 denotes a plug installation hole; 55*a* denotes a shoulder portion; 55*b* denotes an annular seat portion; 55*c* denotes an inner bottom surface; 56 denotes a plug installation hole; 56*a* denotes a shoulder portion; 57 denotes a liquid plug; 57*a* denotes a male screw portion; 57*b* denotes a male screw portion; 57*c* denotes an annular wedge-shaped portion; 57*d* denotes a projecting portion; 58 denotes a stopper; 59 denotes a siphon tube; 60 denotes a pressure relief passage; 62 denotes a liquid cap; 62*a* denotes a female screw portion; 63 denotes an engaging hole; 64 denotes a side hole; 65 denotes an identification ring; 66 denotes a projecting portion; 67 denotes a projecting portion; 70 denotes a dual-purpose gas/liquid plug; 71 denotes a gas supply tube; 73 denotes a stopper; 74 denotes a pressure relief passage; 75 denotes a dual-purpose gas/liquid plug; 75*a* denotes a female screw portion; 76 denotes a side hole; 77 denotes an engaging hole; 81 denotes a multi-purpose plug installation hole; 82 denotes a female screw portion; 83 denotes a retaining nut; 84 denotes a check, valve; 85 denotes a filter; 86 denotes a female screw portion; 87 denotes a plug; 88 denotes a plug; 89 denotes a male screw portion; 90 denotes a plug; and, 91 denotes a plug.

Figure 2:
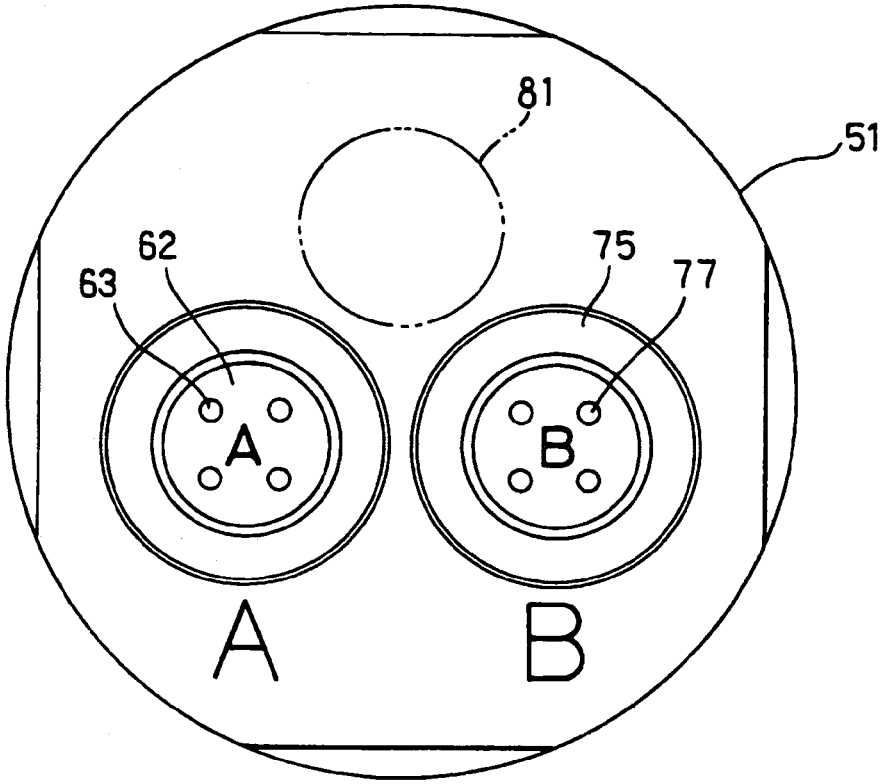
FIG. 2 is a plan view of the connector of the present invention shown in FIG. 1.

As shown in FIGS. 1 and 2, the drum cap 51 is provided with the sleeve portion 52 in its outermost peripheral portion. As shown in FIG. 1, the sleeve portion 52 of the drum cap 51 is provided with the female screw portion 54 in its inner peripheral surface. This screw portion 54 provided in the inner peripheral surface of the drum cap 51 is threadably engaged with a neck portion of the tank 53 (shown in phantom lines in FIG. 1). As is clear from FIG. 1, the neck portion of the tank 53 extends upward from its upper surface.

Formed inside the drum cap 51 are a pair of plug installation holes 55, 56, wherein: one 55 of these holes 55, 56 is used to dispense liquid from the tank 53; and, the other 56 is used to supply a pressurized gas and/or a pressurized liquid into the tank 51. These plug installation holes 55, 56 may be identical in shape and/or dimensions.

Mounted in the plug installation hole 55 in an insertion manner is the liquid plug 57, which is threadably engaged with the female screw portion of a lower portion of the plug installation hole 55 and fixed to the hole 55 in a manner such that the liquid plug 57 does not have its upper surface extended upward beyond an upper surface of the drum cap 51. The liquid plug 57 is provided with an annular flange or stopper 58 in its intermediate portion. As is clear from FIG. 1, the stopper 58 radially outwardly extends to abut on an upper surface of a shoulder portion 55*a* formed in a lower portion of the plug installation hole 55 so that the liquid plug 57 is positioned in a predetermined level in the hole 55.

As shown in FIG. 1, the siphon tube 59, which extends to the bottom of the tank 53, is mounted in the liquid plug 57. Formed around an outer peripheral surface of an upper portion of the siphon tube 59 is the pressure relief passage 60 which has an annular shape to surround the siphon tube 59. This pressure relief passage 60 opens into the side hole 64 formed in an upper portion of the liquid plug 57. A valve for liquid (not shown), which valve is opened when its upper portion is subjected to a pressure equal to or more than a predetermined value in pressure, may be incorporated in the liquid plug 57.

The liquid cap 62 is mounted in the liquid plug 57 in an insertion manner, and provided with the female screw portion 62*a* in a lower enlarged-diameter portion of its sleeve portion. The female screw portion 62*a* of the liquid cap 62 is threadably engaged with the male screw portion 57*a* (shown in FIG. 5(A)) of the liquid plug 57 and fixed to the plug 57, which male screw portion 57*a* is formed adjacent to the annular stopper 58 of the liquid plug 57 to extend upward from the stopper 58. As shown in FIG. 2, a predetermined number of the engaging holes 63 are formed in an upper surface of the liquid cap 62 and used when the liquid cap 62 is turned by the user.

Figure 3:
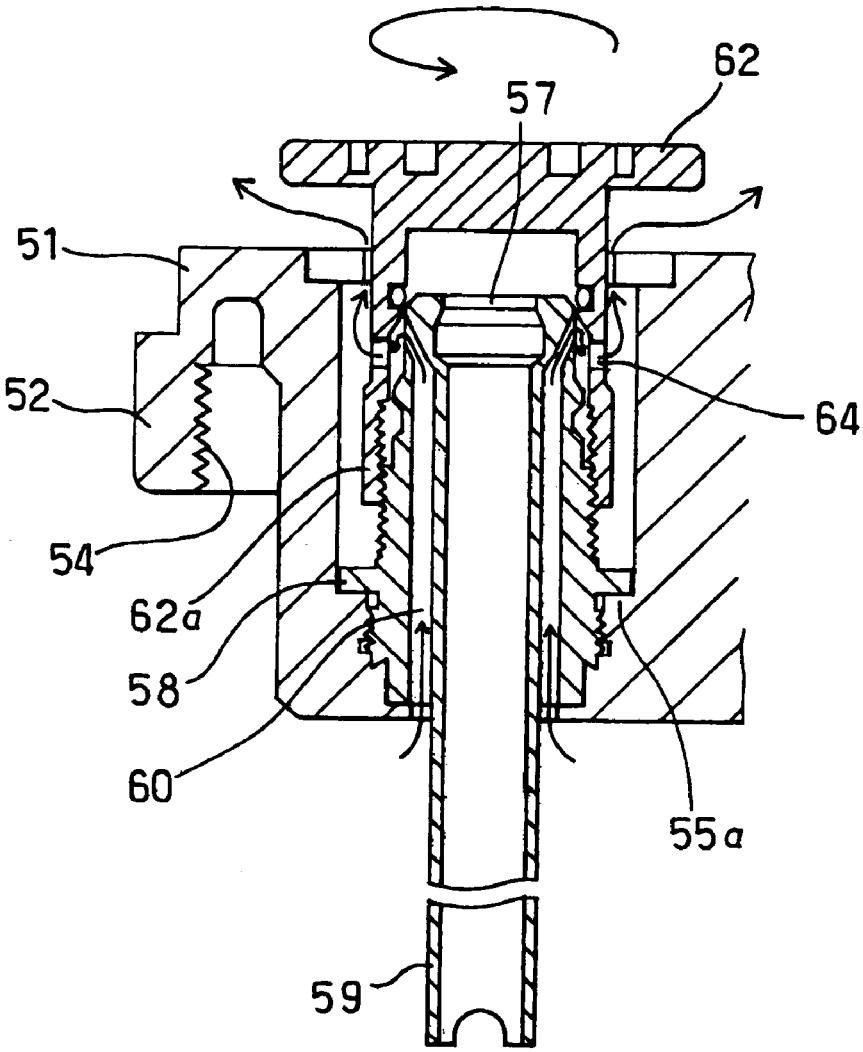
FIG. 3 is a longitudinal sectional view of an essential part of the connector of the present invention shown in FIG. 1.

The side hole 64 is formed in an intermediate portion of the liquid cap 62, and communicates with the pressure relief passage 60 when the liquid cap 62 is turned in its threadably disengaging direction. In other words, as shown in FIG. 3, in a condition in which the liquid cap 62 is threadably tightened, an upper-end opening portion of the pressure relief passage 60 is closed by means of an inner wall of the liquid cap 62. On the other hand, when the liquid cap 62 is threadably loosened, the upper-end opening portion of the pressure relief passage 60 is separated from the inner wall of the liquid cap 62 to permit the pressure of the interior of the tank 53 to escape from the tank 53 through the pressure relief passage 60 and the side hole 64 to the outside (see FIG. 3).

Mounted in an upper end portion of the plug installation hole 55 in an insertion manner is the identification ring 65 which is capable of performing a first and a second function. In the first function, the identification ring 65 is mounted on each of the liquid cap 62 and the dual-purpose gas/liquid cap 75 to enable the user to easily identify each of these caps 62, 75. In order to enhance such identification, it is possible for the user to have the identification ring 65 colored by a predetermined pigment and dispose the thus colored identification ring 65 only on the side of the plug installation hole 55, for example.

Figure 4:
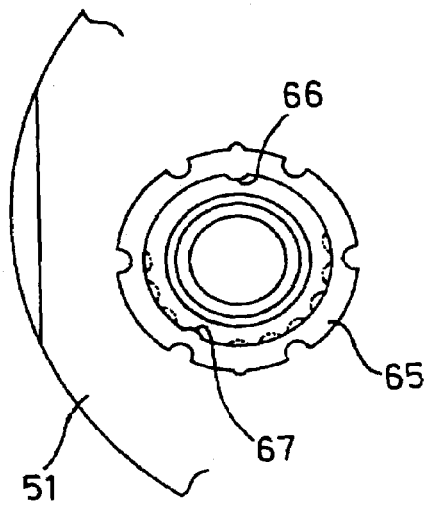
FIG. 4 is a plan view of an identification ring of the connector of the present invention shown in FIG. 1.

On the other hand, in the second function, the identification ring 65 is used to identify the contents (i.e., types of chemical liquid) of the tank 53. In order to facilitate such identification of the types of chemical liquid, as shown in FIG. 4, a pair of the projecting portions 66, 67 are formed in an inner peripheral surface of the identification ring 65. One 66 of these projecting portions 66, 67 of the identification ring 65 is for a reference use, while the other 67 is for an identification use. The latter or identification projecting portion 67 of the identification ring 65 is angularly spaced from the former or reference projecting portion 66 of the same identification ring 65. Each type of chemical liquids is represented by each of angles formed between these projecting portions 66, 67, wherein various possible positions of the identification projecting portion 67 are shown in phantom lines in FIG. 4.

A liquid socket (not shown in FIG. 4), which is connected with the liquid plug 57, is provided with a plurality of concave portions or vertical grooves (one of which corresponds in angular position to one of the identification projecting portions 67 shown in phantom lines in FIG. 4) in its outer peripheral surface. These concave portions or vertical grooves of the liquid socket correspond in angular position to both the reference projecting portion 66 and the identification projecting portion 67 of the identification ring 65. In other words, a specific one of the identification rings 65 has its reference projecting portion 66 and its identification projecting portion 67 arranged so as to correspond only to a specific one of the types of chemical liquids. Therefore, there is no fear, without fail, that the liquid socket for the specific chemical liquid is connected with each of the wrong liquid plug 57 and the wrong dual-purpose gas/liquid plug 70 both for the wrong types of chemical liquids other than the specific chemical liquid.

In the plug installation hole 56 for supplying the pressurized gas (and/or pressurized liquid) into the tank 53: the dual-purpose gas/liquid plug 70, which is substantially identical in construction with the liquid plug 57 except for the gas supply tube 71 not reaching to a surface of the chemical liquid contained in the tank 53, is threadably engaged with the female screw portion formed in a lower portion of the plug installation hole 56 and fixed to the hole 56. In other words, the dual-purpose gas/liquid plug 70 is provided with the flange or annular stopper 73 in its intermediate portion. This stopper 73 radially outwardly extends, and has its lower surface abut on an upper surface of the shoulder portion 56*a* formed in a lower portion of the plug installation hole 56, so that the dual-purpose gas/liquid plug 70 is precisely positioned when mounted in the plug installation hole 56 in an insertion manner.

Formed around the gas supply tube 71 is the pressure relief passage 74 which opens sideward in an upper portion of the dual-purpose gas/liquid tube 70 to communicate with the side hole 76 formed in an intermediate portion of the dual-purpose gas/liquid cap 75.

In other words, the dual-purpose gas/liquid cap 75 has its female screw portion 75*a* threadably engaged with the male screw portion of the annular stopper 73 of the dual-purpose gas/liquid plug 70 and is fixedly mounted on the plug 70, wherein: the female screw portion 75*a* is formed in the enlarged-diameter portion formed in a lower portion of the sleeve portion of the dual-purpose gas/liquid cap 75; and, the male screw portion of the dual-purpose gas/liquid plug 70 is formed adjacent to the annular stopper 73 to extend upward from the stopper 73. As is in the case described above, by threadably loosening the dual-purpose gas/liquid cap 75, it is possible to have the pressure relief passage 74 communicate with the side hole 76. Although not shown in the drawings, a valve for gas may be incorporated in the dual-purpose gas/liquid plug 70, wherein such valve for gas is opened when has its upper portion subjected to a pressure equal to or more than a predetermined value. Also formed in an upper surface of the dual-purpose gas/liquid cap 75 are the engaging holes 77 which are substantially identical in construction with the engaging holes 63 described above.

In more preferable embodiments of the present invention, for example: the male screw portion 57*a* of the liquid plug 57, which screw portion 57*a* is threadably engaged with the female screw portion 62*a* of the liquid cap 62, differs in diameter from the male screw portion of the dual-purpose gas/liquid plug 70, which male screw portion is threadably engaged with the female screw portion 75*a* of the dual-purpose gas/liquid cap 75; and, it is also possible to have the liquid plug 57 differ in diameter from a head portion of the dual-purpose gas/liquid plug 70. These more preferable embodiments make it possible to prevent the liquid cap 62 from being connected with the dual-purpose gas/liquid plug 70 and also to prevent the dual-purpose gas/liquid cap 75 from being connected with the liquid plug 57.

In recent years, user's requests for the realization of circulation of a chemical liquid contained in a tank during non-use of the tank increase in order to prevent any sludge from being developed in the chemical liquid contained in the tank. Such circulation of the chemical liquid is realized by sucking the chemical liquid from the tank through a siphon tube, wherein the thus sucked chemical liquid is returned to the tank. However, in a conventional type of the tank: a conventional gas plug used in the tank is too small in its inner diameter when used in circulating the chemical liquid through the tank since the conventional gas plug is heretofore intended for supplying only a pressurized gas to the tank. Consequently, in the present invention: the plug installation hole 56 is enlarged in diameter so as to be substantially equal to the diameter of the plug installation hole 55; and, the plugs 57 and 70, which are threadably engaged with the plug installation holes 55 and 56, respectively, are also enlarged in diameter so as to prevent the chemical liquid thus circulated through the tank from decreasing in flow rate.

Further, heretofore: an O-ring is used as a sealing means to seal a clearance between a lower portion of the liquid plug 57 and a lower portion of the plug installation hole 55; and, a lock member for preventing the liquid plug 57 from turning relative to the plug installation hole 55 is provided on the side of this plug installation hole 55.

Figure 5A:
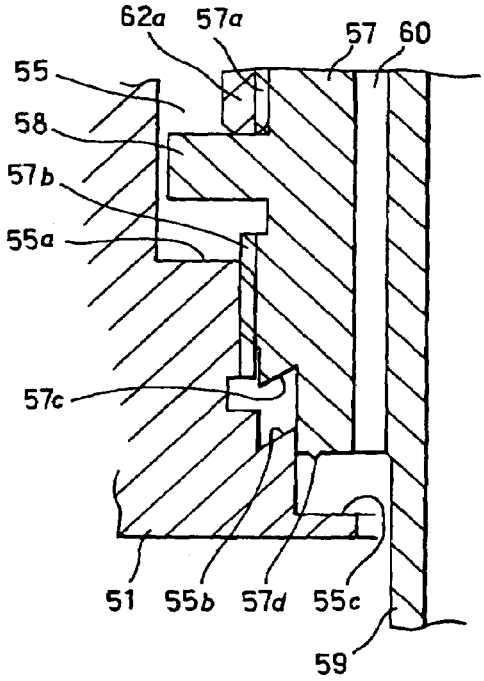
FIG. 5(A) is a longitudinal sectional view of the connector of the present invention shown in FIG. 1, illustrating a sealing means and a plug locking means both employed in the connector of the present invention.
Figure 5B:
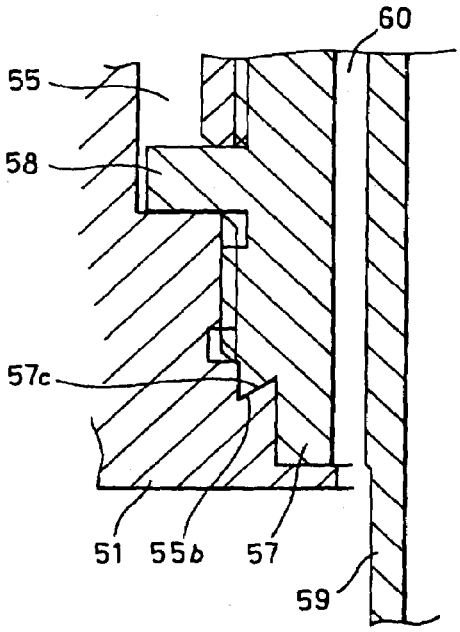
FIG. 5(B) is a longitudinal sectional view of the connector of the present invention shown in FIG. 1, illustrating a sealing means and a plug locking means both employed in the connector of the present invention.

In contrast with this, in the present invention: as shown in FIG. 5(A), the annular wedge-shaped portion 57*c* is formed adjacent to the male screw portion 57*b* of the liquid plug 57 to extend downward from the male screw portion 57*b*, wherein the male screw portion 57 is formed adjacent to the annular stopper 58 to extend downward from the stopper 58. On the other hand, as shown in FIG. 5(B), the annular seat portion 55*b* is formed in a lower portion, of the plug installation hole 55 to correspond to the annular wedge-shaped portion 57*c* of the liquid plug 57. Due to the above construction, when the liquid plug 57 is threadably tightened to move downward as viewed in FIG. 5(A), the annular wedge-shaped portion 57*c* of the liquid plug 57 is hermetically seated on the corresponding annular seat portion 55*b* of the plug installation hole 55, so that the clearance between the liquid plug 57 and the plug installation hole 55 is sealed, as shown in FIG. 5(B).

Further, the projecting portion 57*d* formed in the bottom surface of the liquid plug 57 is welded to an inner bottom surface 55*c* of the plug installation hole 55 through an ultrasonic welding process. Due to this, the liquid plug 57 is fixedly mounted in the plug installation hole 55 and therefore prevented from being threadably loosened from the plug installation hole 55.

Each of the sealing means and the plug locking means both of which are employed in the present invention has the above-mentioned construction. Due to this, it is possible for the connector of the present invention to reduce the number of its constituent elements or parts, downsize its size, reduce its manufacturing cost, facilitate its assembly operations, and also facilitate its maintenance. Incidentally, the above-mentioned sealing means and the locking means may be used also on the side of the dual-purpose gas/liquid plug 70.

In the connector of the present invention having the above construction: by having the liquid plug 62 and the dual-purpose gas/liquid cap 75 threadably engaged with the liquid plug 57 and the dual-purpose gas/liquid plug 70, respectively, and tightened therein during non-use of the tank 53, it is possible for the user to completely seal, without fail, both: the plug installation hole 55, which is used in dispensing the chemical liquid from the tank 53; and, the other plug installation hole 56, which is used in supplying the pressurized gas to the tank 53. This makes it possible for the user to eliminate any cap for covering and sealing the entire drum cap 51. Further, only by threadably loosening the liquid cap 62 and/or the dual-purpose gas/liquid cap 75, it is also possible for the user to relieve any excessive pressure developed inside the tank 53, if necessary.

In dispensing the chemical liquid from the tank 53, the liquid cap 62 is removed from the liquid plug 57. Then, the liquid socket (not shown) is directly coupled to the liquid plug 57, through which liquid socket the chemical liquid contained in the tank 53 is dispensed from the tank 53 to the outside. At this time, when the vertical concave portions or grooves formed in such liquid socket (not shown) fail to align in angular position with the pair of projecting portions 66, 67 of the liquid ring 65, it is not possible for the user to insert such a wrong liquid socket into the plug installation hole 55, which prevents such a wrong liquid socket from being coupled to the liquid plug 57. Consequently, in the connector of the present invention, there is no fear that the liquid plug 57 is coupled to the wrong liquid socket. Due to this, in the present invention, there is no fear that any wrong chemical liquid other than the required chemical liquid is dispensed from the tank 53 to the outside. This is true on the side of the dual-purpose gas/liquid cap 75. In supplying the pressurized gas to the tank 53, the dual-purpose gas/liquid cap 75 is removed from the dual-purpose gas/liquid plug 70. After that, the dual-purpose gas/liquid socket (not shown) is coupled to the dual-purpose gas/liquid plug 70 so that the pressurized gas is supplied from the dual-purpose gas/liquid socket (not shown) to the tank 53 through the dual-purpose gas/liquid plug 70.

On the side of the liquid plug 57, a valve (not shown) incorporated in the liquid socket (not shown) is opened when the liquid socket is coupled to the liquid plug 57, so that the liquid socket communicates with the interior of the tank 53 through the liquid plug 57. It is also possible to have this type of incorporated valve (hereinafter referred to as the "gas valve") incorporated in the dual-purpose gas/liquid socket (not shown) being coupled to the dual-purpose gas/liquid plug 70. Consequently, when the pressurized gas is supplied form the dual-purpose gas/liquid socket (not shown) to the tank 53 through such gas valve of the socket, the pressure in the tank 53 is developed so that the chemical liquid contained in the tank 53 is also pressurized, whereby the chemical liquid contained in the tank 53 is forcibly dispensed from the tank 53 to the outside through the siphon tube 59 and the liquid plug 57.

Incidentally, as already described in the above, it impossible to prevent the liquid plug 57 and the dual-purpose gas/liquid plug 70 from being coupled to the wrong liquid cap (62) and the wrong dual-purpose gas/liquid cap (75), respectively, by having the male screw portions of these plugs 57 and 70 differ in diameter from the corresponding female screw portions of these wrong caps (62 and 75), respectively, and/or by having the head portions of these plugs 57 and 70 differ in diameter from the corresponding concave portions of these wrong caps (62 and 75), respectively.

In other possible embodiments of the present invention, it is possible to form the multi-purpose plug installation hole 81 in the drum cap 51. In order to downsize the connector of the present invention and to save the space in the connector of the present invention as a whole, preferably the multi-purpose plug installation hole 81 and the other two plug installation holes 55, 56 are disposed in a triangular shape in arrangement as a whole.

Figure 6:
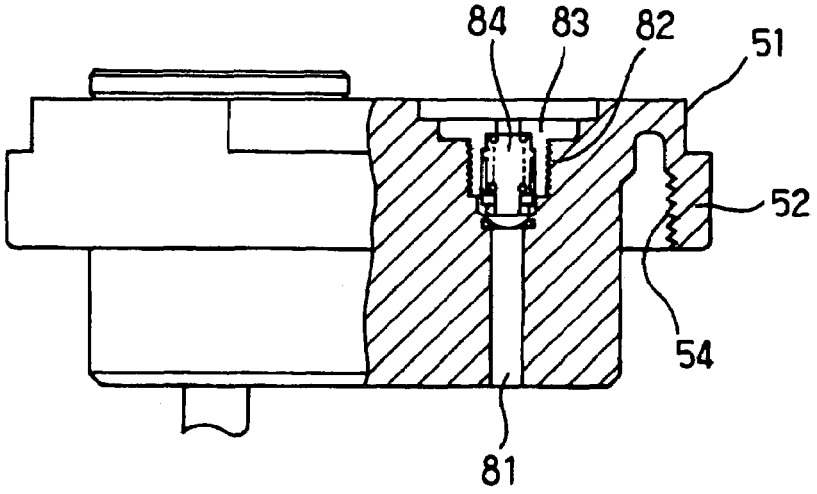
FIG. 6 is a longitudinal sectional view of a first example in application of the multi-purpose plug installation hole employed in the connector of the present invention.
Figure 7:
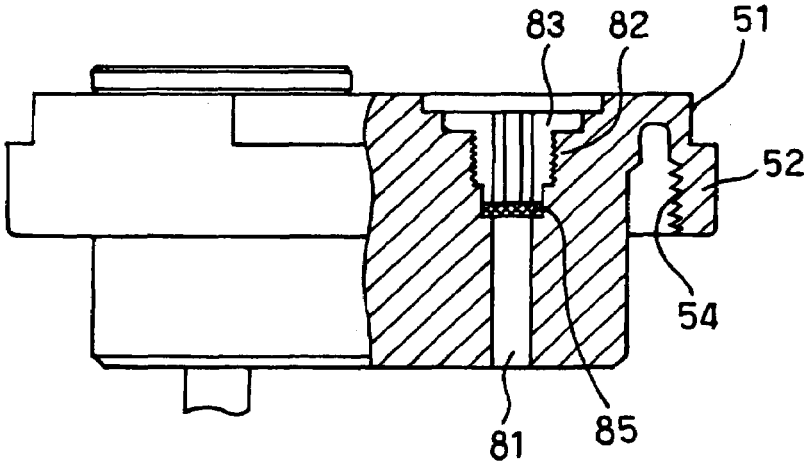
FIG. 7 is a longitudinal sectional view of a second example in application of the multi-purpose plug installation hole employed in the connector of the present invention.

The multi-purpose plug installation hole 81 has found various applications in industry. For example, the holes 81 may be shaped into various forms in accordance with its individual applications. More specifically, in each of FIGS. 6 and 7, the multi-purpose plug installation hole 81 is shaped into a pressure relief port in application. Of these examples, one shown in FIG. 6 has a construction in which: a female screw portion 82 is provided in a portion of an upper inner wall of the multi-purpose plug installation hole 81; and, a cap nut 83 is threadably engaged with the female screw portion 82 of the multi-purpose plug installation hole 81 to hold a check valve 84 in the hole 81. On the other hand, the other example shown in FIG. 7 has a construction in which: as is in the case of the example shown in FIG. 6, the same female screw portion 82 as that of the example of FIG. 6 is provided in a portion of an upper inner wall of the multi-purpose plug installation hole 81; and, the same cap nut 83 as that of the example of FIG. 6 is threadably engaged with this female screw portion 82 of the multi-purpose plug installation hole 81 to hold a filter member 85 in the hole 81. This filter member 85 has the facility for maintaining a constant pressure inside the tank 53 when the tank 53 contains a chemical liquid, for example such as a dilute hydrogen peroxide aqueous solution and the like which tends to increase the pressure of the interior of the tank 53 containing the chemical liquid therein.

Figure 8:
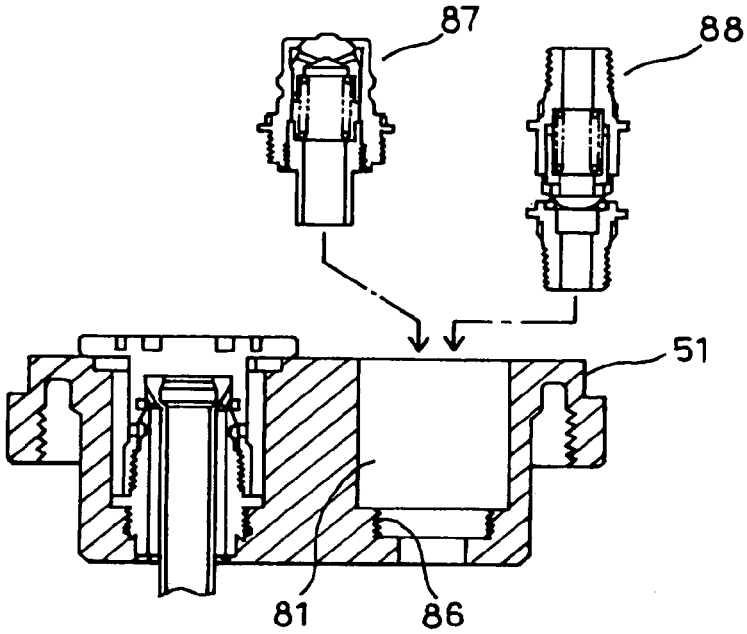
FIG. 8 is a longitudinal sectional view of a third example in application of the multi-purpose plug installation hole employed in the connector of the present invention.
Figure 9:
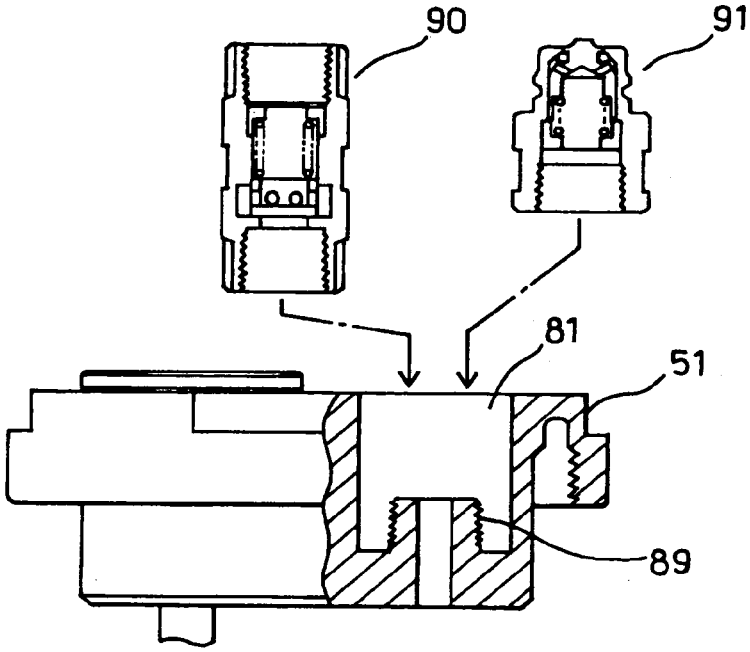
FIG. 9 is a longitudinal sectional view of a fourth example in application of the multi-purpose plug installation hole employed in the connector of the present invention.
Figure 10:
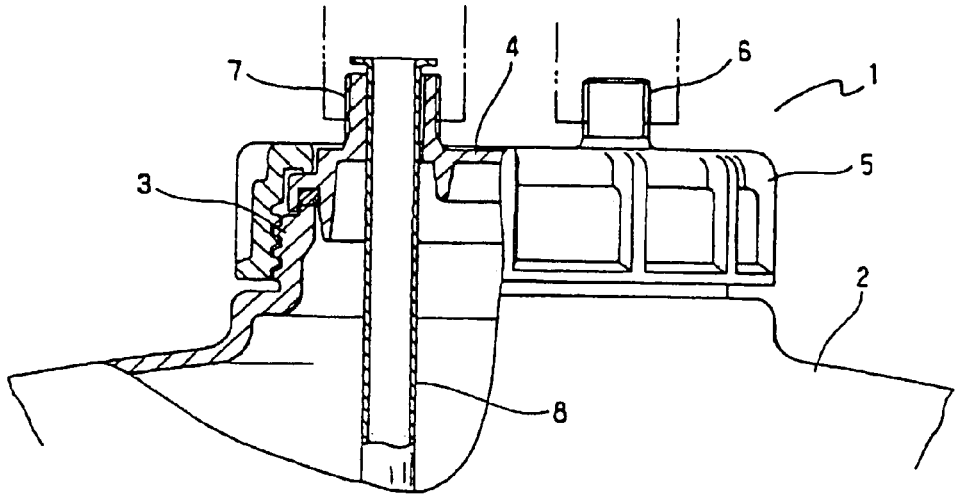
FIG. 10 PRIOR ART
FIG. 10 is a longitudinal sectional view of an example of the conventional connector, illustrating the example of the conventional connector in construction.
Figure 11:
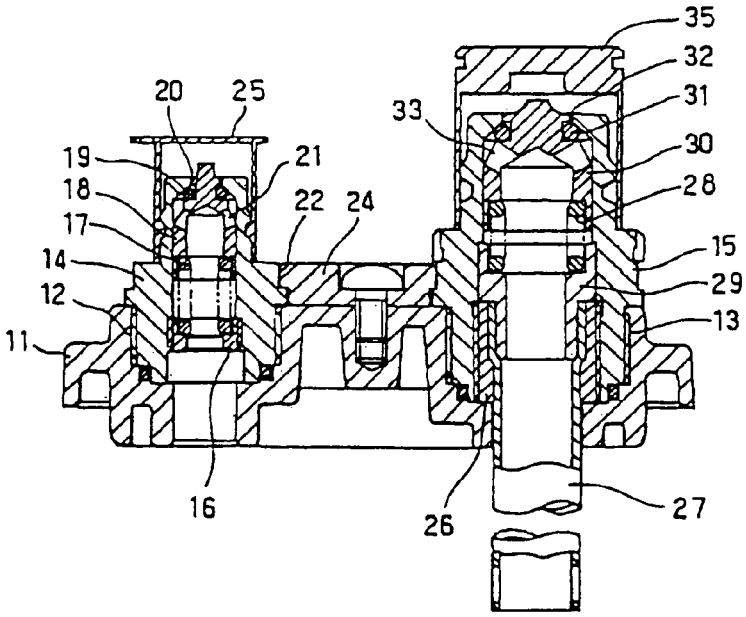
FIG. 11 PRIOR ART
FIG. 11 is a longitudinal sectional view of another example of the conventional connector, illustrating the latter example of the conventional connector in construction.

Each of FIGS. 8 and 9 shows further another example in application of the multi-purpose plug installation hole 81, wherein the multi-purpose plug installation hole 81 is modified into a secondary liquid plug installation port or into a gas plug installation port. More specifically, the example shown in FIG. 8 has a construction in which: a female screw portion 86 is provided in a portion of a lower inner wall of the multi-purpose plug installation hole 81; and, one of plugs 87, 88, each of which is provided with a male screw portion corresponding to the female screw portion 86 of the multi-purpose plug installation hole 81, is threadably engaged with the multi-purpose plug installation hole 81 so as to be fixed to the hole 81. On the other hand, the remaining example shown in FIG. 9 has a construction in which: a male screw portion 89 of the multi-purpose plug installation hole 81 is formed in the inner bottom surface of the hole 81 so as to extend upward as viewed in FIG. 9; and, one of plugs 90, 91, each of which is provided with a female screw portion corresponding to the male screw portion 89 of the hole 81, has its corresponding female screw portion threadably engaged with the male screw portion 89 of the hole 81 and fixed thereto in such remaining example of FIG. 9.

It is understood that the above-described embodiments of the present invention are merely illustrative applications of the principles of the present invention. Numerous other embodiments may be devised by those skilled in the art without departing from the spirit and scope of the present invention, as defined in the appended claims.

Finally, the present application claims the Convention Priority based on Japanese Patent Application No. 2003-373233 filed on Oct. 31, 2003, which is herein incorporated by reference.

What is claimed is:

1. A connector for dispensing liquid from a tank (53), said connector having a construction in which: both a liquid dispensing plug installation hole (55) and a dual-purpose gas/liquid supply plug installation hole (56) are formed in a drum cap (51) which is threadably engaged with a neck portion of said tank (53); a liquid plug (57), which is provided with a siphon tube (59) extending to an inner bottom surface of said tank (53), is fixedly mounted in said liquid dispensing plug installation hole (55) in a manner such that said liquid plug (57) prevents its upper surface from being positioned in a level beyond an upper surface of said drum cap (51); a dual-purpose gas/liquid plug (70) is fixedly mounted in said dual-purpose gas/liquid supply plug installation hole (56) in a manner such that said dual-purpose gas/liquid plug (70) prevents its upper surface from being positioned in a level beyond said upper surface of said drum cap (51); and, a liquid cap (62) and a dual-purpose gas/liquid cap (75) are detachably mounted on said liquid plug (57) and said dual-purpose gas/liquid plug (70), respectively, in an insertion manner so as to hermetically close an upper opening portion of each of said plugs (57, 70).

2. The connector for dispensing the liquid from the tank (53) as set forth in claim 1, wherein: said liquid cap (62) is threadably engaged with a male screw portion (57*a*) formed in an outer peripheral surface of said liquid plug (57); said dual-purpose gas/liquid cap (75) is threadably engaged with a male screw portion formed in an outer peripheral surface of said dual-purpose gas/liquid plug (70); said male screw portion (57*a*) of said liquid plug (57) differs in diameter from said male screw portion of said dual-purpose gas/liquid plug (70).

3. The connector for dispensing the liquid from the tank (53) as set forth in claim 1, wherein: a pressure relief mechanism for relieving a pressure developed inside said tank (53) from said tank (53) is provided between: said liquid plug (57) and said liquid cap (62); and, between said dual-purpose gas/liquid plug (70) and said dual-purpose gas/liquid cap (75).

4. The connector for dispensing the liquid from the tank (53) as set forth in claim 3, wherein said pressure relief mechanism is constructed of: a pressure relief passage (60, 74) formed in said plug (57, 70); and, a side hole (64, 76) formed in said cap (62, 75), wherein an upper opening portion of said pressure relief passage (60, 74) is closed by a side wall of said cap (62, 75) when said cap (62, 75) is threadably tightened, which upper opening portion of said pressure relief passage (60, 74) is permitted to communicate with said side hole (64, 76) when said cap (62, 75) is threadably loosened to separate said upper opening portion of said pressure relief passage (60, 74) from said side wall of said cap (62, 75).

5. The connector for dispensing the liquid from the tank (53) as set forth in claim 1, wherein an identification ring (65) for identifying said plug (57, 70) is mounted on an upper end portion of at least one of said plug installation holes (55, 56) in an insertion manner.

6. The connector for dispensing the liquid from the tank (53) as set forth in claim 5, wherein said identification ring (65) is provided with a projecting portion or a concave portion in its inner peripheral surface, wherein said projecting portion or said concave portion indicates the type of liquid contained in said tank (53).

7. The connector for dispensing the liquid from the tank (53) as set forth in claim 1, wherein said drum cap (51) is provided with a multi-purpose plug installation hole (81) in addition to the pair of said plug installation plugs (57, 70).

8. The connector for dispensing the liquid from the tank (53) as set forth in claim 7, wherein: said liquid dispensing plug installation hole (57), said dual-purpose gas/liquid supply plug installation hole (70) and said multi-purpose plug installation hole (81) forms a triangular shape in their arrangement as a whole.

9. The connector for dispensing the liquid from the tank (53) as set forth in claim 1, wherein said multi-purpose plug installation hole (81) is capable of being used as a pressure relief port.

10. The connector for dispensing the liquid from the tank (53) as set forth in claim 1, wherein said multi-purpose plug installation hole (81) is capable of being used as a secondary liquid plug installation hole or as a secondary dual-purpose gas/liquid plug installation hole.

11. The connector for dispensing the liquid from the tank (53) as set forth in claim 1, wherein: an annular wedge-shaped portion (57*c*) is formed adjacent to a male screw portion (57*b*) of each of said liquid plug (57) and said dual-purpose gas/liquid plug (70) to extend downward from said male screw portion (57*b*) which is also formed in a lower portion of each of said liquid plug (57) and said dual-purpose gas/liquid plug (70); said male screw portion of each of said liquid plug (57) and said dual-purpose gas/liquid plug (70) is threadably engaged with each of said plug installation holes (55, 56); and, an annular seat portion, with which said annular wedge-shaped portion (57*c*) is engaged, is formed in a lower portion of each of said plug installation holes (55, 56).

12. The connector for dispensing the liquid from the tank (53) as set forth in claim 1, wherein an outer bottom surface of each of said liquid plug (57) and said dual-purpose gas/liquid plug (70) abuts on an inner bottom surface of each of said plug installation holes (55, 56) and is welded to said inner bottom surface of each of said plug installation holes (55, 56).

13. The connector for dispensing the liquid from the tank (53) as set forth in claim 1, wherein said liquid plug (57) is equal in inner diameter to said dual-purpose gas/liquid plug (70).

14. The connector for dispensing the liquid from the tank (53) as set forth in claim 2, wherein: a pressure relief mechanism for relieving a pressure developed inside said tank (53) from said tank (53) is provided between: said liquid plug (57) and said-liquid cap (62); and, between said dual-purpose gas/liquid plug (70) and said dual-purpose gas/liquid cap (75).

15. The connector for dispensing the liquid from the tank (53) as set forth in claim 2, wherein an identification ring (65) for identifying said plug (57,70) is mounted on an upper end portion of at least one of said plug installation holes (55,56) in an insertion manner.

16. The connector for dispensing the liquid from the tank (53) as set forth in claim 2, wherein said drum cap (51) is provided with a multi-purpose plug installation hole (81) in addition to the pair of said plug installation plugs (57, 70).

17. The connector for dispensing the liquid from the tank (53) as set forth in claim 2, wherein said multi-purpose plug installation hole (81) is capable of being used as a pressure relief port.

18. The connector for dispensing the liquid from the tank (53) as set forth in claim 2, wherein said mulit-purpose plug installation hole (81) is capable of being used as a secondary liquid plug installation hole or as a secondary dual-purpose gas/liquid plug installation hole.

19. The connector for dispensing the liquid from the tank (53) as set forth in claim 2, wherein: an annular wedge-shaped portion (57*c*) is formed adjacent to a male screw portion (57*b*) of each of said liquid plug (57) and said dual-purpose gas/liquid plug (70) to extend downward from said male screw portion (57*b*) which is also formed in a lower portion of each of said liquid plug (57) and said dual-purpose gas/liquid plug (70); said male screw portion of each of said liquid plug (57) and said dual-purpose gas/liquid plug (70) is threadably engaged with each of said plug installation holes (55, 56); and, an annular seat portion, with which said annular wedge-shaped portion (57*c*) is engaged, is formed in a lower portion of each of said plug installation holes (55, 56).

20. The connector for dispensing the liquid from the tank (53) as set forth in claim 2, wherein an outer bottom surface of each of said liquid plug (57) and said dual-purpose gas/liquid plug (70) abuts on an inner bottom surface of each of said plug installation holes (55, 56) and is welded to said inner bottom surface of each said plug installation holes (55, 56).

* * * * *